US008360572B2

(12) United States Patent
Katagami et al.

(10) Patent No.: US 8,360,572 B2
(45) Date of Patent: Jan. 29, 2013

(54) TRANSPORT APPARATUS HAVING SIDE MEMBERS AND RECORDING APPARATUS HAVING SIDE MEMBERS

(75) Inventors: Satoru Katagami, Matsumoto (JP); Jun Yamada, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 217 days.

(21) Appl. No.: 12/868,875

(22) Filed: Aug. 26, 2010

(65) Prior Publication Data

US 2011/0050826 A1 Mar. 3, 2011

(30) Foreign Application Priority Data

Aug. 27, 2009 (JP) ..... 2009-196446

(51) Int. Cl.
*B41J 2/01* (2006.01)
*B65H 9/00* (2006.01)
*B65H 23/04* (2006.01)

(52) U.S. Cl. ..... 347/104; 271/238; 242/615

(58) Field of Classification Search ..... None
See application file for complete search history.

(56) References Cited

U.S. PATENT DOCUMENTS

2002/0186291 A1* 12/2002 Kanazawa et al. ..... 347/104

FOREIGN PATENT DOCUMENTS

JP 2000-153604 6/2000
JP 2000153604 A * 6/2000

* cited by examiner

*Primary Examiner* — Geoffrey Mruk
*Assistant Examiner* — Bradley Thies
(74) *Attorney, Agent, or Firm* — Workman Nydegger

(57) ABSTRACT

A transport apparatus which transports a sheet-like medium along a transport direction while one surface of the sheet-like medium is sucked to a holding surface, includes side members having opposed faces which are opposed to a portion of the holding surface at a position near the edge of the holding surface in a width direction intersecting with the transport direction. The side members form spaces between the other surface of the sheet-like medium and the opposed faces when the sheet-like medium is transported in a state where edges of the sheet-like medium in the width direction are interposed between the opposed faces and the holding surface.

8 Claims, 4 Drawing Sheets

TRANSPORT APPARATUS HAVING SIDE MEMBERS AND RECORDING APPARATUS HAVING SIDE MEMBERS

The entire disclosure of Japanese Patent Application No. 2009-196446 filed Aug. 27, 2009 is incorporated by reference in its entirety herein.

BACKGROUND

1. Technical Field

The present invention relates to a transport apparatus and a recording apparatus including the transport apparatus.

2. Related Art

In general, an ink jet printer (hereinafter, referred to as a "printer") is well known as a recording apparatus which performs recording by ejecting liquid onto a sheet-like medium (for example, JP-A-2000-153604).

The printer described in JP-A-2000-153604 includes a platen on which suction holes are provided, a suction fan, and a side pressing unit. In the printer described in JP-A-2000-153604, the sheet-like medium is transported while the suction fan is driven to suck the sheet-like medium (recording sheet) to the platen and edges of the sheet-like medium are suppressed from being lifted off with the side pressing unit.

At this time, an inclined portion for guiding the sheet-like medium is provided at an upstream side portion in the transport direction on the side pressing unit included in the printer described in JP-A-2000-153604. In the printer described in JP-A-2000-153604, when the edges of the sheet-like medium are lifted off, the sheet-like medium is guided to a downstream side in the transport direction while the edges thereof are made to be in slide contact with the inclined portion, and the edges of the sheet-like medium are pressed with the side pressing unit on the platen. With this configuration, the sheet-like medium is suppressed from being lifted off.

However, when the sheet-like medium is transported while the edges thereof are made to be in slide contact with the side pressing unit in such a manner, there has been a problem that a load is added on the sheet-like medium due to friction.

SUMMARY

An advantage of some aspects of the invention is to provide a transport apparatus and a recording apparatus which can suppress a load added on a sheet-like medium and suppress the sheet-like medium from being lifted off.

A transport apparatus according to an aspect of the invention transports a sheet-like medium along a transport direction while one surface of the sheet-like medium is sucked to a holding surface. The transport apparatus includes side members having opposed faces which are opposed to a portion of the holding surface at a position near the edge of the holding surface in a width direction intersecting with the transport direction. The side members form spaces between the other surface of the sheet-like medium and the opposed faces when the sheet-like medium is transported in a state where edges of the sheet-like medium in the width direction are interposed between the opposed faces and the holding surface.

With this configuration, the sheet-like medium is transported in a state where the edges of the sheet-like medium in the width direction are interposed between the opposed faces and the holding surface. Therefore, the edges of the sheet-like medium can be suppressed from being lifted off. Then, when the sheet-like medium is transported, the side members form the spaces between the other surface of the sheet-like medium and the opposed faces. Therefore, the sheet-like medium to be transported can be suppressed from being in slide contact with the side members. Accordingly, a load added on the sheet-like medium can be suppressed while the sheet-like medium can be suppressed from being lifted off.

In the transport apparatus according to the aspect of the invention, it is preferable that the side members be sucked to the side of the holding surface together with the sheet-like medium, so that the side members are flexuraly deformed along the transport direction.

With this configuration, the side members are sucked to the side of the holding surface together with the sheet-like medium, so that the side members are flexuraly deformed along the transport direction. Therefore, the side members can be contacted with the holding surface in a suitable manner at the time of the suction.

In the transport apparatus according to the aspect of the invention, it is preferable that the side members be sucked to the side of the holding surface together with the sheet-like medium, so that the side members are flexuraly deformed along the transport direction, while spaces formed between the other surface of the sheet-like medium and the opposed faces are kept.

With this configuration, the side members are sucked to the side of the holding surface together with the sheet-like medium, so that the side members are flexuraly deformed along the transport direction, while the spaces formed between the other surface of the sheet-like medium and the opposed faces are kept. Accordingly, a load added on the sheet-like medium can be reliably suppressed.

The transport apparatus according to the aspect of the invention further includes tension application units which apply a tensile force along the transport direction to the side members.

With this configuration, the transport apparatus includes tension application units which apply a tensile force along the transport direction to the side members. Therefore, the side members can be suppressed from being slackened and being in slide contact with the sheet-like medium.

A recording apparatus according to another aspect includes a recording unit which performs recording by making a recording material adhere to the sheet-like medium sucked to the holding surface, and the above transport apparatus.

With this configuration, the same operation effects as the transport apparatus can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment in which a recording apparatus according to the invention is embodied as a lateral type ink jet printer will be described with reference to FIG. 1 to FIG. 4. It is to be noted that "longitudinal direction," "horizontal direction," and "vertical direction" are indicated based on directions shown by arrows in FIG. 1 to FIG. 4 in the description below.

Figure 1:
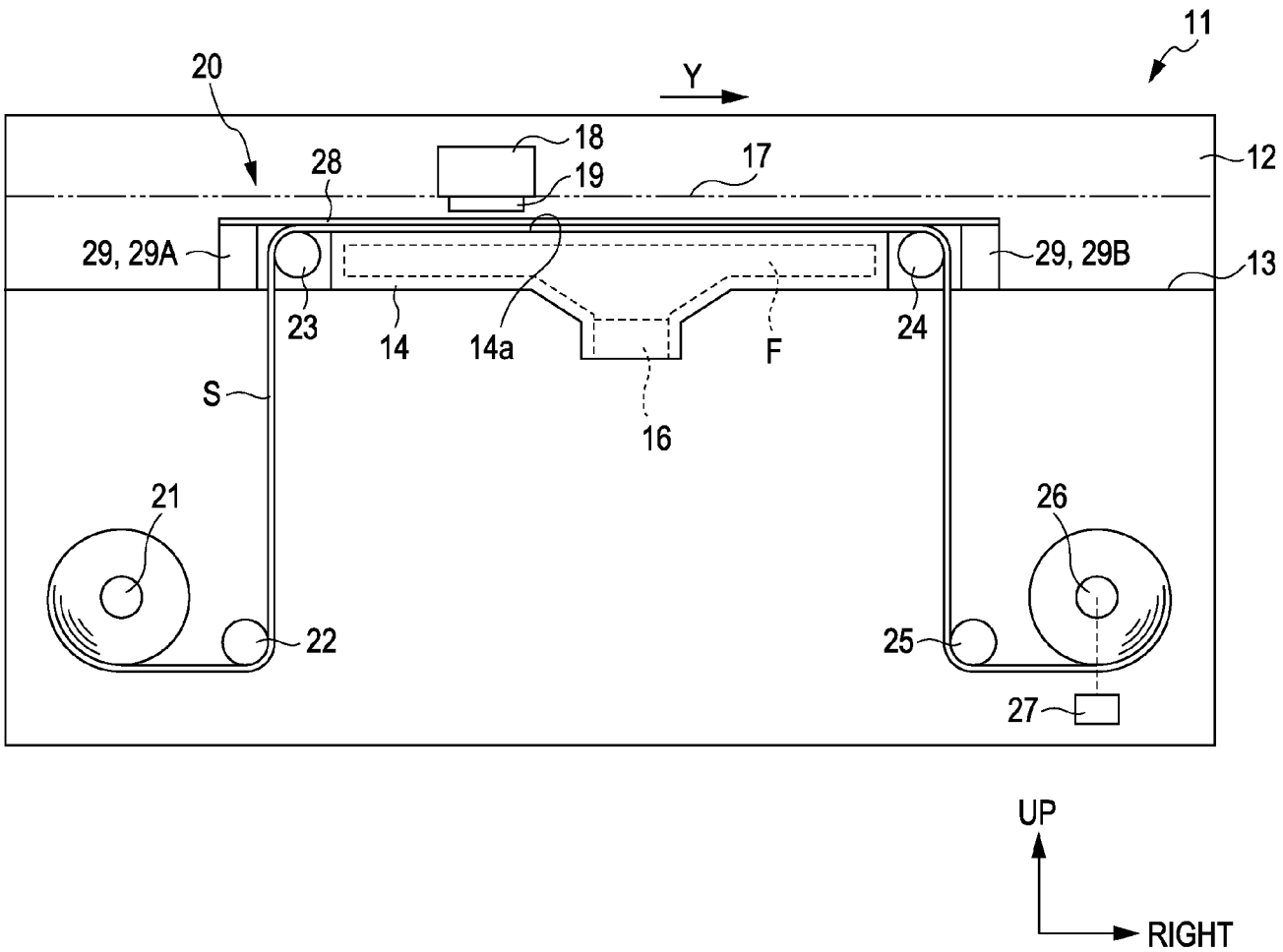
FIG. 1 is a front view illustrating a schematic configuration of a recording apparatus according to an embodiment.

As shown in FIG. 1, a printer 11 as the recording apparatus includes a cuboid main body case 12. A plate-like base board 13 is provided on a slightly upper position with respect to a center in the vertical direction in the main body case 12 to divide an inner portion of the main body case 12 into an upper portion and a lower portion.

A platen 14 is arranged on the base board 13. An upper surface of the platen 14 forms a holding surface 14*a*, and a negative pressure formation region F is formed in the platen 14. A plurality of suction holes 15 (see, FIG. 4) which communicate with the negative pressure formation region F are formed on the holding surface 14*a*. A suction fan 16 for generating a negative pressure in the negative pressure formation region F is provided on the lower portion of the platen 14. Accordingly, while the suction fan 16 is driven, when a continuous sheet S as a sheet-like medium is arranged on the platen 14, the continuous sheet S is sucked to the holding surface 14*a*.

Guide rails 17 (shown by a dot-dot-dash line in FIG. 1) extending in the horizontal direction are provided so as to be paired on both of front and rear sides of the platen 14 in the main body case 12. Upper surfaces of the guide rails 17 are higher than the holding surface 14*a* of the platen 14. A rectangular carriage 18 is supported on the upper surfaces of both guide rails 17 so as to be reciprocatable in the horizontal direction along both guide rails 17 by the driving of a driving mechanism (not shown). A recording head 19 as a recording unit is supported on a lower surface side of the carriage 18. The recording unit performs recording by making ink as a recording material adhere to the continuous sheet S sucked to the holding surface 14*a*.

A transport apparatus 20 is accommodated in the main body case 12. The transport apparatus 20 transports the continuous sheet S along a transport direction Y (front direction) on the platen 14 while sucking one surface side (back surface side) of the continuous sheet S to the holding surface 14*a*. A specified range on the platen 14 is set as a recording region R (see, FIG. 2), and the continuous sheet S is intermittently transported on the recording region R basis. Ink is ejected from nozzles (not shown) onto an upper surface (surface to be recorded) of the continuous sheet S with the reciprocating movement of the carriage 18, while the continuous sheet S is in a state where the continuous sheet S is being stopped on the platen 14 by the intermittent transport on the recording region R basis. The nozzles are provided on the lower surface side of the recording head 19. With the ink ejection, a recording process is performed onto the continuous sheet S.

Next, the transport apparatus 20 is described.

The transport apparatus 20 includes a winding shaft 21 extending in the longitudinal direction, rollers 22 to 25, a winding-up shaft 26, a transport motor 27 for rotating the winding-up shaft 26, paired belt-form side members 28 (see, 28A, 28B in FIG. 2), and fixing mechanisms 29 (29A, 29B) as tension application units.

The continuous sheet S is wounded over the rollers 22 to 25 in a state where the left edge side of the continuous sheet S is wound around the winding shaft 21 and the right edge side thereof is wound around the winding-up shaft 26. Then, the continuous sheet S is transported from the side of the winding shaft 21 to the side of the winding-up shaft 26 while being in slide contact on the holding surface 14*a* of the platen 14 constituting a transport path with the rotation driving of the transport motor 27.

Figure 2:
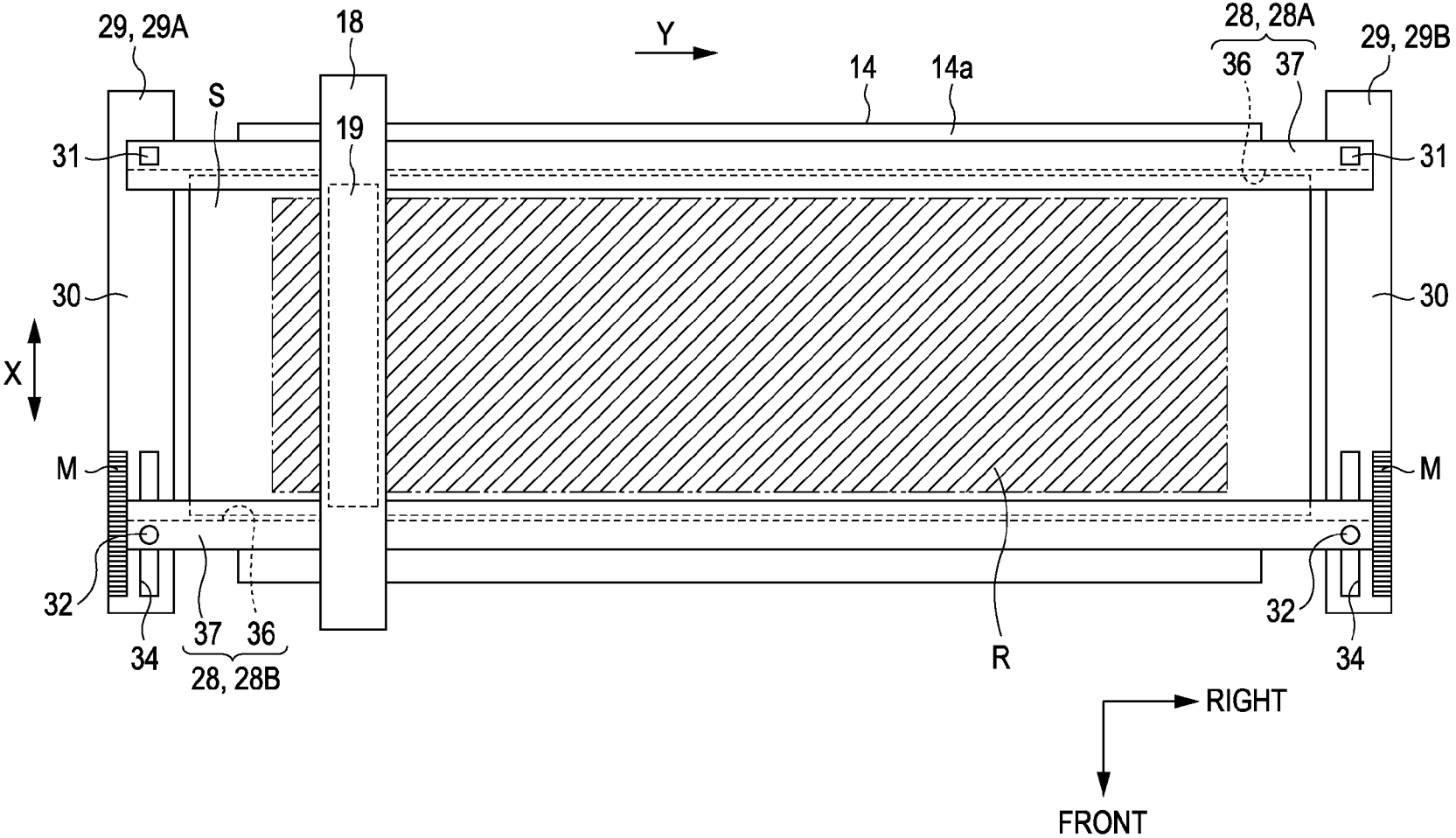
FIG. 2 is a top view illustrating a carriage and a transport apparatus.

As shown in FIG. 2, the side members 28 are arranged in the vicinity of both edges of the platen 14 in the width direction X perpendicular to the transport direction Y so as to extend along the transport direction Y. Further, the both edges of the side members 28 in the transport direction Y are fixed to the fixing mechanisms 29 in a detachable manner. Since the side members 28 are detachable from the fixing mechanisms 29, the side members 28 can be easily detached when maintenance of the platen 14 is performed, for example.

Figure 3:
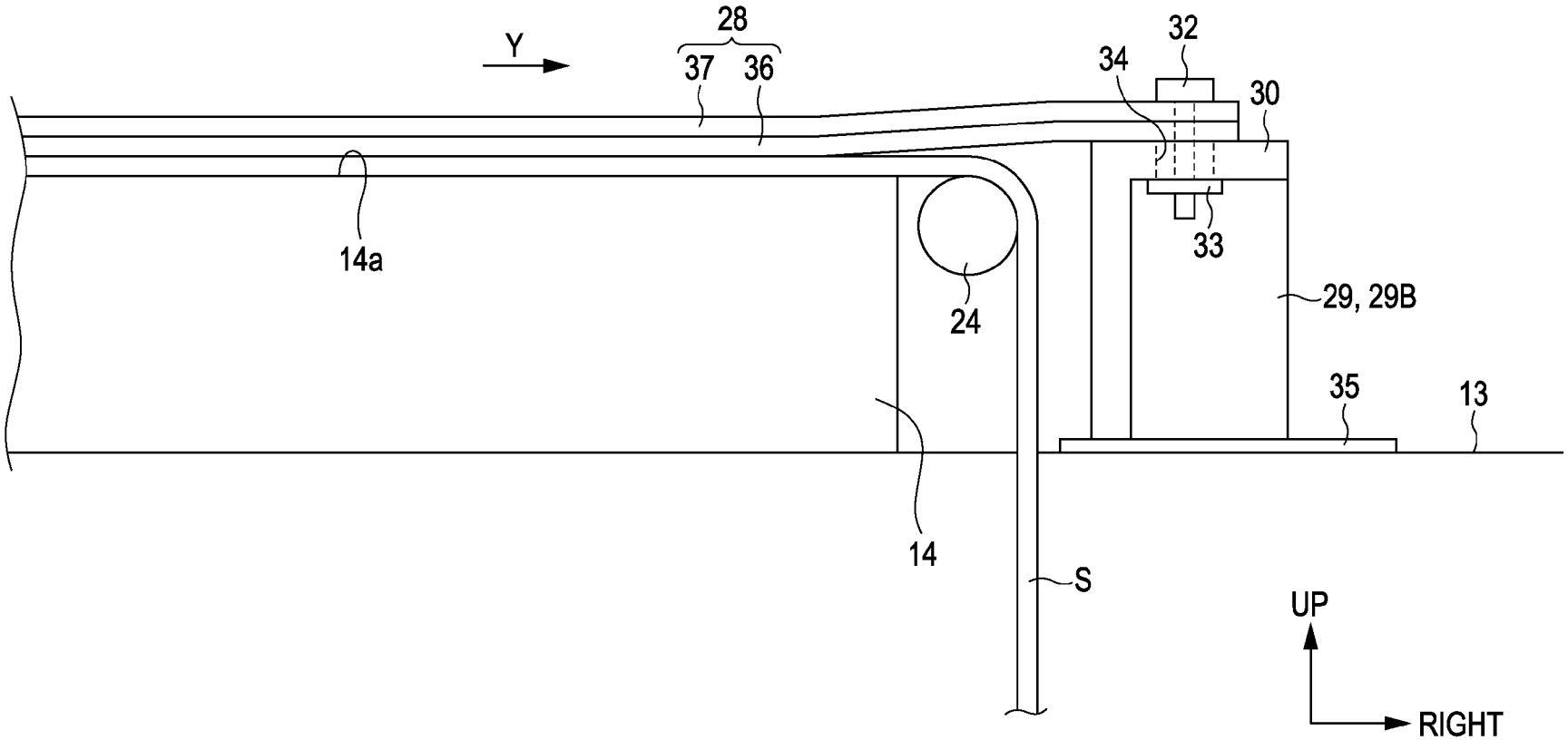
FIG. 3 is a front view illustrating a side member and a fixing mechanism.

As shown in FIG. 2 and FIG. 3, the fixing mechanisms 29 include main body portions 30 arranged on both of the left and right sides of the platen 14, fixing pins 31 for fixing both of the left and right edges of the side member 28A at the rear side (see, FIG. 2), and bolts 32 and nuts 33 (see, FIG. 3) for fixing both of the left and right edges of the side member 28B at the front side. Further, long holes 34 and scales M (see, FIG. 2) are provided on the main body portions 30 so as to extend in the longitudinal direction. The bolts 32 are inserted through the long holes 34.

The fixing mechanism 29A at the left side is fixed on the base board 13. It is preferable that a fixing position of the fixing mechanism 29A be finely adjustable. On the other hand, the fixing mechanism 29B at the right side can be slidably moved in the horizontal direction along a slide rail 35 (see, FIG. 3) provided on the base board 13. At the same time, the fixing mechanism 29B can be fixed on an arbitrary position on the slide rail 35 by a locking member (not shown). The positions of the side members 28 are fixed in a state where the fixing mechanism 29B is moved in the transport direction Y to apply a tensile force to the side members 28. It is to be noted that the tensile force applied to the side members 28 is set in consideration of contraction due to change in temperature.

Further, the side member 28A is fixed to the main body portions 30 with the fixing pins 31. It is preferable that the fixing positions of the fixing pins 31 be finely adjustable. On the other hand, the side member 28B is moved together with the bolts 32 and the nuts 33 along the long holes 34 extending in the longitudinal direction so that the fixing position of the side member 28B can be adjusted in the longitudinal direction.

Each of the side members 28 is configured by adhering a film-like support member 36 and a space formation member 37 to each other in the vertical direction. Both of the support member 36 and the space formation member 37 are made of a resin material and have flexibility. As a material of the support member 36 and the space formation member 37, for example, polypropylene or the like can be used. Further, in order to ensure the strength of the adhesion, the support member 36 and the space formation member 37 are preferably made of the same material but may be made of different materials.

Figure 4:
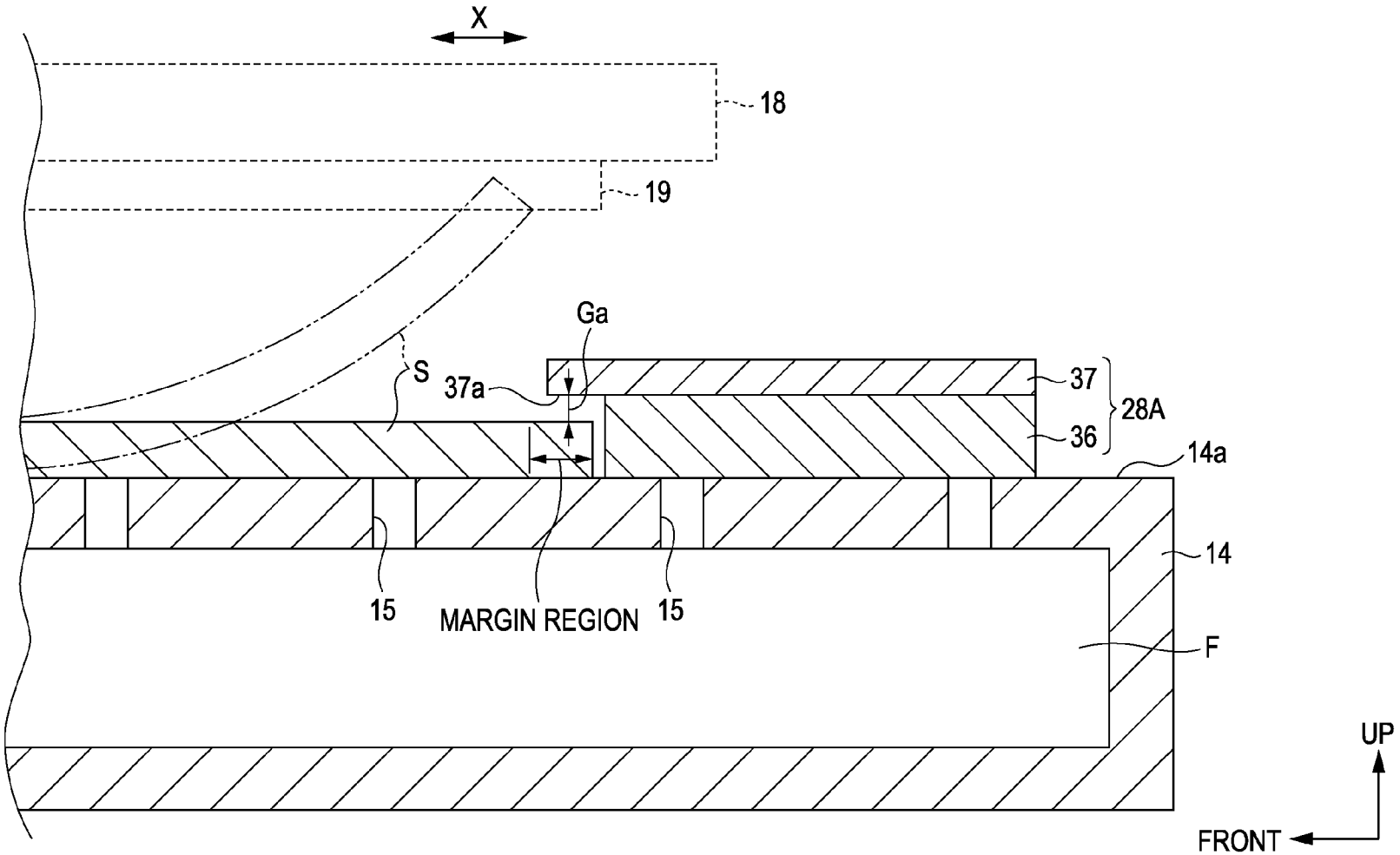
FIG. 4 is an end view for explaining a configuration and an action of the side member.

As shown in FIG. 2 and FIG. 4, both ends of one side (front end side of the side member 28A and rear end side of the side member 28B) of the space formation members 37 arranged on the upper side are arranged as follows. That is, both ends of the other side of the space formation members 37 are arranged so as to project in the direction of the inner side of the platen 14 in a cantilever form with respect to ends of the support members 36 arranged on the lower side. Positions of the ends of the other side (rear end side of the side member 28A and front end side of the side member 28B) of the space formation members 37 may be the same or may not be the same as end positions of the support members 36. Then, lower surface sides of the projecting portions of the space formation members 37 are opposed faces 37*a* (see, FIG. 4). Each opposed face 37*a* is opposed to a portion of the holding surface 14*a* at a position near the edge thereof in the width direction X.

Further, the continuous sheet S is transported in a state where the back surface side thereof is sucked to the holding surface 14*a* while edges thereof in the width direction X are interposed between the opposed faces 37*a* and the holding surface 14*a*.

Since the side members 28 have flexibility, when the continuous sheet S is sucked to the holding surface 14*a*, the support members 36 are sucked to the side of the holding surface 14*a* together with the continuous sheet S. Therefore, as shown in FIG. 3, the side members 28 are flexuraly deformed along the transport direction Y. That is to say, the side members 28 are separated from the continuous sheet S and the platen 14 in a state where the tensile force is applied to the side members 28 with the fixing mechanism 29. However, when the side members 28 are sucked together with the continuous sheet S, the side members 28 are flexuraly deformed toward the side of the platen 14 so that the support members 36 are abutted against the holding surface 14*a*. Then, when the support members 36 are abutted against the holding surface 14*a* with the flexural deformation of the side members 28, the space formation members 37 and the holding surface 14*a* are not abutted against each other as shown in FIG. 4. Further, spaces Ga are formed between the surface (the other surface) of the continuous sheet S and the opposed faces 37*a*.

Note that in order to ensure the spaces Ga, the thickness of each support member 36 is set to be larger than the maximum sheet thickness (for example, approximately 0.35 mm) of the continuous sheet S used in the printer 11. On the other hand, the thickness of each space formation member 37 forming the opposed face 37*a* is set to be approximately 0.2 mm. Further, the length of each side member 28 in the transport direction Y as a longer direction is approximately 1 m. On the other hand, the length (width) of each space formation member 37 in the width direction X as a shorter side direction is set to be approximately 15 to 20 mm. Further, the length (width) of each opposed face 37*a* in the width direction X is set to be approximately 2 mm such that a portion of each space formation member 37 projecting from each support member 36 in a cantilever form is not flexuraly deformed in the width direction X.

Thus, the portion of each space formation member 37 projecting from each support member 36 is designed so as not to be flexuraly deformed in the width direction X. Accordingly, the side members 28 are flexuraly deformed along the transport direction Y as the side members 28 are sucked to the side of the holding surface 14*a* together with the continuous sheet S, but the side members 28 are not flexuraly deformed along the width direction X. Further, the spaces Ga formed between the back surface of the continuous sheet S and the opposed faces 37*a* are kept.

As shown in FIG. 4, margin regions on which recording process is not performed are set on the continuous sheet S at both edges of approximately 3 mm in the width direction X. When the continuous sheet S is transported, the side member 28B is adjusted to the scales M and is moved in the width direction X. Therefore, both edges of approximately 2 mm of the continuous sheet S in the width direction X, which are the margin regions, are adjusted to be interposed between the opposed faces 37*a* and the holding surface 14*a*. That is, the positions of the side members 28 are adjusted such that both edges of the continuous sheet S in width direction X are not in slide contact with the support members 36 when the continuous sheet S is transported and the side members 28 are not overlapped with the recording region R at the time of recording process. Since the side members 28 are detachable, side members having an appropriate size other than the above side members can be used as the situation demands depending on the sheet thickness and margin regions of the continuous sheet S to be used.

Next, action of the transport apparatus 20 is described.

When the recording process is performed, the continuous sheet S is first set on the transport apparatus 20. Then, the side member 28B is moved in the width direction X according to the sheet width of the continuous sheet S and is adjusted such that both edges of approximately 2 mm of the continuous sheet S in the width direction, which are the margin regions, are interposed between the opposed faces 37*a* and the holding surface 14*a*. Further, the fixing mechanism 29B is moved in the transport direction Y so that the side members 28 are provided in a tension manner.

Subsequently, the suction fan 16 is driven to suck the continuous sheet S and the side members 28 on the platen 14, and the transport motor 27 is driven to transport the continuous sheet S on the recording region R basis. At this time, if the side members 28 are not provided, as shown by the dot-dot-dash line in FIG. 4, there arises a risk that edges of the continuous sheet S are lifted off from the holding surface 14*a*. In particular, when, for example, the continuous sheet S is a large-sized sheet having a large sheet width, a possibility where such lifting off of the sheet is caused is increased because the edges are curled due to change in temperature during storage.

Then, a separated distance (platen gap) between the lower surface of the recording head 19 and the holding surface 14*a* is approximately 1.1 mm. In comparison with the distance, the lifting off of the continuous sheet S becomes as large as 10 to 15 mm in some case. Therefore, if the edges of the continuous sheet S are lifted off, there arises a risk that the lifted edges are abutted against the recording head 19 and contaminated, or landing position of ink is deviated. This causes deterioration in the recording quality.

In contrast, in the embodiment, when the continuous sheet S is transported, the support members 36 of the side members 28 are sucked to the side of the holding surface 14*a* together with the continuous sheet S. At this time, although the side members 28 do not press the edges of the continuous sheet S, the side members 28 play a role in keeping a state where the edges of the continuous sheet S are close to the holding surface 14*a*. Although a suction force cannot be acted in a state where the edges of the continuous sheet S are largely lifted off, if the suction force can be acted in a state where the edges of the continuous sheet S are made close to the holding surface 14*a*, the lifting off of the edges can be eliminated without directly pressed the edges.

That is to say, the side members 28 are arranged so as to cover the edges of the continuous sheet S when the continuous sheet S is set on the transport apparatus 20. Further, the side members 28 are sucked together with the continuous sheet S, so that the lifted edges of the continuous sheet S are made close to the holding surface 14*a*. At this time, the opposed faces 37*a* of the side members 28 are temporarily abutted against the lifted edges of the continuous sheet S in some case. However, since the side members 28 are not moved with transport, a load added on the continuous sheet S due to slide contact can be suppressed to be small.

Then, when the suction fan 16 is driven, the back surface of the continuous sheet S which is arranged on a position close to the holding surface 14*a* by the side members 28 is sucked onto the holding surface 14*a*. Further, the spaces Ga are formed between the surface of the continuous sheet S and the opposed faces 37*a*. Accordingly, when the continuous sheet S is moved with the transport, the continuous sheet S can be suppressed from being damaged due to slide contact with the side members 28. Further, for example, even when the continuous sheet S is formed with a multilayered structure of a base material, glue, a separator, and the like, since the side members 28 do not press the edges of the continuous sheet S, overspreading of the glue or the like is not caused.

The continuous sheet S is reliably sucked onto the holding surface 14*a* at the time of the recording process performed in the interval of the intermittent transport. Therefore, the landing position of ink droplets is not deviated, thereby obtaining recording quality with high accuracy.

Since each side member 28 is formed with a film-like member, the apparatus is not increased in size and the side member 28 does not interfere the movement of the recording head 19. Further, even in a case where the air is blown along the longitudinal direction on the platen 14 for drying the recorded surface, the air blow is not impeded. In addition, since the side members 28 are separated from the holding surface 14*a* upon release of the suction, operation can proceed without need of detaching the side members 28 when the continuous sheet S is replaced, for example.

Further, for example, when the side members 28 are formed with plate members having no flexibility, there arise the following risks. That is, the side members 28 are not sufficiently sucked onto because spaces are generated between the support members 36 and the holding surface 14*a* due to a manufacturing error or the like. Or, the side members 28 are partially made in slide contact with the continuous sheet S because bumps are generated on the opposed faces 37*a*. In comparison therewith, since the side members 28 are formed with a thin film-like members having flexibility in the embodiment, the support members 36 can be uniformly abutted against the holding surface 14*a* in a conformable manner. In addition, even when the continuous sheet S is abutted against the side members 28, the side members 28 are flexuraly deformed, so that a reactive force is reduced. Therefore, a load added on the continuous sheet S can be suppressed.

According to the above described embodiment, the following effects can be obtained.

(1) The continuous sheet S is transported in a state where edges thereof in the width direction X are interposed between the opposed faces 37*a* and the holding surface 14*a*. Therefore, the edges of the continuous sheet S can be suppressed from being lifted off. When the continuous sheet S is transported, the side members 28 form the spaces Ga between the surface of the continuous sheet S and the opposed faces 37*a*. Therefore, the continuous sheet S to be transported can be suppressed from being in slide contact with the side members 28. Accordingly, a load added on the continuous sheet S can be suppressed while the continuous sheet S can be suppressed from being lifted off.

(2) The side members 28 are sucked to the side of the holding surface 14*a* together with the continuous sheet S, so that the side members 28 are flexuraly deformed along the transport direction Y. Therefore, the side members 28 can be contacted with the holding surface 14*a* in a suitable manner at the time of the suction.

(3) The side members 28 are sucked to the side of the holding surface 14*a* together with the continuous sheet S, so that the side members 28 are flexuraly deformed along the transport direction Y while the spaces Ga formed between the surface of the continuous sheet S and the opposed faces 37*a* are kept. Accordingly, a load added on the continuous sheet S can be reliably suppressed.

(4) The fixing mechanisms 29 which apply a tensile force along the transport direction Y to the side members 28 are further included. Therefore, the side members 28 can be suppressed from being contracted and being in slide contact with the continuous sheet S.

Note that the above embodiment may be changed to another embodiment as follows.

The side members 28 may be integrally formed with a single member.

Both of the side members 28A, 28B may be movable in the width direction X. In this case, the continuous sheet S can be transported in a state where the continuous sheet S is stepped to the center.

Both of the fixing mechanisms 29A, 29B may be movable in the transport direction Y.

The configuration may be such that the side member 28B and the fixing mechanism 29B may not be moved.

The size of the side members 28 and the spaces Ga can be arbitrary set depending on the size of the continuous sheet S.

Instead of the continuous sheet S, a long plastic film or fabric may be used as a target.

In the above embodiment, although the recording apparatus is embodied as the ink jet printer, a liquid ejecting apparatus which ejects and discharges liquid other than ink may be employed. The recording apparatus can be applied to various types of liquid ejecting apparatuses including a liquid ejecting head or the like which discharges a trace amount of liquid droplets. Note that the terminology liquid droplet represents the state of liquid which is discharged from the above liquid ejecting apparatus. For example, a granular shape, a tear drop shape, and a shape that pulls a tail in a string-like form therebehind are included as the liquid droplets. The terminology liquid herein represents materials which can be ejected by the liquid ejecting apparatus. For example, any materials are included as long as the materials are in a liquid phase. For example, materials in a liquid state having high viscosity or low viscosity or a fluid state such as a sol, gel water, other inorganic solvents, an organic solvent, a solution, a liquid resin or a liquid metal (molten metal) can be included as the liquid. Further, the liquid is not limited to liquid as one state of a material but includes a solution, a dispersion or a mixture of particles of a functional material made of a solid material such as pigment particles or metal particles. Typical examples of the liquid are ink described in the above embodiment and liquid crystal. The terminology ink herein encompasses various liquid compositions such as common aqueous ink and oil ink, gel ink and hot melt ink. Specific examples of the liquid ejecting apparatus include a liquid ejecting apparatus which ejects liquid in forms of a dispersion or a solution of a material such as an electrode material or a coloring material. The material such as the electrode material or the coloring material are used for manufacturing liquid crystal displays, electroluminescence (EL) displays, surface emitting displays and color filters, for example. Further, the specific examples of the liquid ejecting apparatus include a liquid ejecting apparatus which ejects a bioorganic material used for manufacturing biochips, a liquid ejecting apparatus which ejects liquid used as a precision pipette and serving as a sample, a dyeing apparatus and a micro dispenser. Other examples of the liquid ejecting apparatus include a liquid ejecting apparatus which pinpoint ejects lubricating oil to a precision machine such as a watch or a camera. Further, a liquid ejecting apparatus which ejects a transparent resin solution of an ultraviolet curable resin or the like onto a substrate in order to form a hemispherical microlens (optical lens) used for an optical communication element is included as the liquid ejecting apparatus. In addition, a liquid ejecting apparatus which ejects an acid or alkali etching solution for etching a substrate or the like may be employed as the liquid ejecting apparatus. The invention can be applied to any of these liquid ejecting apparatuses.

What is claimed is:

1. A transport apparatus which transports a medium along a transport direction while a back surface of the medium is sucked to a holding surface, comprising:

side members having opposed faces which are opposed to a portion of the holding surface at a position near the edge of the holding surface in a width direction intersecting with the transport direction, wherein the side members form spaces between an upper surface of the medium and the opposed faces when the medium is transported in a state where edges of the medium in the width direction are interposed between the opposed faces and the holding surface.

2. The transport apparatus according to claim 1, wherein the side members are sucked to the side of the holding surface together with the medium so that the side members are flexibly deformed along the transport direction.

3. The transport apparatus according to claim 1, wherein the side members are sucked to the side of the holding surface together with the medium so that the side members are flexibly deformed along the transport direction while spaces formed between the other surface of the medium and the opposed faces are kept.

4. The transport apparatus according to claim 1, further comprising tension application units which apply tensile force along the transport direction to the side members.

5. A recording apparatus comprising:

a recording unit which performs recording by making a recording material adhere to a medium sucked to a holding surface; and a transport apparatus which transports the medium along a transport direction while a back surface of the medium is sucked to the holding surface, the transport apparatus including:

side members having opposed faces which are opposed to a portion of the holding surface at a position near an edge of the holding surface in a width direction intersecting with the transport direction, wherein the side members form spaces between an upper surface of the medium and the opposed faces when the medium is transported in a state where edges of the medium in the width direction are interposed between the opposed faces and the holding surface.

6. The recording apparatus according to claim 5, wherein the side members are sucked to the side of the holding surface together with the medium so that the side members are flexibly deformed along the transport direction.

7. The recording apparatus according to claim 5, wherein the side members are sucked to the side of the holding surface together with the medium so that the side members are flexibly deformed along the transport direction while spaces formed between the other surface of the medium and the opposed faces are kept.

8. The recording apparatus according to claim 5, wherein the transport apparatus further comprises tension application units which apply tensile force along the transport direction to the side members.

* * * * *